United States Patent [19]

Yarbrough, Jr.

[11] Patent Number: 4,986,459

[45] Date of Patent: Jan. 22, 1991

[54] TOOL HOLDER

[76] Inventor: Charles R. Yarbrough, Jr., 316 Ingleside Dr., Fredericksburg, Va. 22405

[21] Appl. No.: 465,427

[22] Filed: Jan. 16, 1990

[51] Int. Cl.[5] ..... A45F 5/00; F42B 39/02

[52] U.S. Cl. ..... 224/253; 224/240; 224/904; 224/195

[58] Field of Search ..... 224/904, 269, 253, 252, 224/230, 226, 196, 195, 192, 224, 223, 222, 163, 240, 247, 248, 251, 262, 263

[56] References Cited

U.S. PATENT DOCUMENTS

| | | | |
|---|---|---|---|
| 601,725 | 4/1888 | Zeugschmidt | 224/904 |
| 1,600,027 | 9/1926 | Welsand | 224/223 |
| 1,648,565 | 11/1927 | Primley | 224/240 |
| 3,664,560 | 5/1972 | Perkins | 224/253 |
| 4,190,148 | 2/1980 | Schade, II et al. | 224/196 |
| 4,226,105 | 10/1980 | Wehrman | 70/456 R |
| 4,253,593 | 3/1981 | Patterman | 224/253 |
| 4,307,825 | 12/1981 | Patterman | 224/231 |
| 4,467,946 | 8/1984 | Brown | 224/252 |
| 4,496,088 | 1/1985 | Tuthill | 224/253 |
| 4,598,027 | 7/1986 | Johnson | 428/542.8 |
| 4,779,655 | 10/1988 | Olson | 150/134 |
| 4,790,461 | 12/1988 | Stover | 224/241 |
| 4,796,790 | 1/1989 | Hamilton | 224/253 |
| 4,805,819 | 2/1989 | Collins | 224/232 |
| 4,821,933 | 4/1989 | Seber | 224/238 |
| 4,828,154 | 5/1989 | Clifton, Jr. | 224/253 |
| 4,917,281 | 4/1990 | Ostermiller | 224/253 |
| 4,923,105 | 5/1990 | Snyder | 224/904 |

FOREIGN PATENT DOCUMENTS

| | | | |
|---|---|---|---|
| 88/03461 | 5/1988 | PCT Int'l Appl. | 224/253 |

*Primary Examiner*—Henry J. Recla
*Assistant Examiner*—Keith K. Kupferschmid

[57] ABSTRACT

A tool holder which efficiently organizes a bartender's tools is disclosed. The tool holder has a pliable support, a first pocket for holding a pen having a first side edge attached to a first side of the support and a second side edge attached to a second side of the support, a hook attached to the first side of the support for holding a bottle opener, a second pocket attached to the first side of the support for holding a lighter, a third pocket attached to the first side of the support for holding a knife, and a ring attached to the first side of the support for holding a towel. The support may be secured to the body of a user by way of a belt so that the second side of the support is adjacent a hip of the user. A hook-and-pile fastening arrangement may be used to releasably fasten the support to the belt at a desired position.

22 Claims, 4 Drawing Sheets

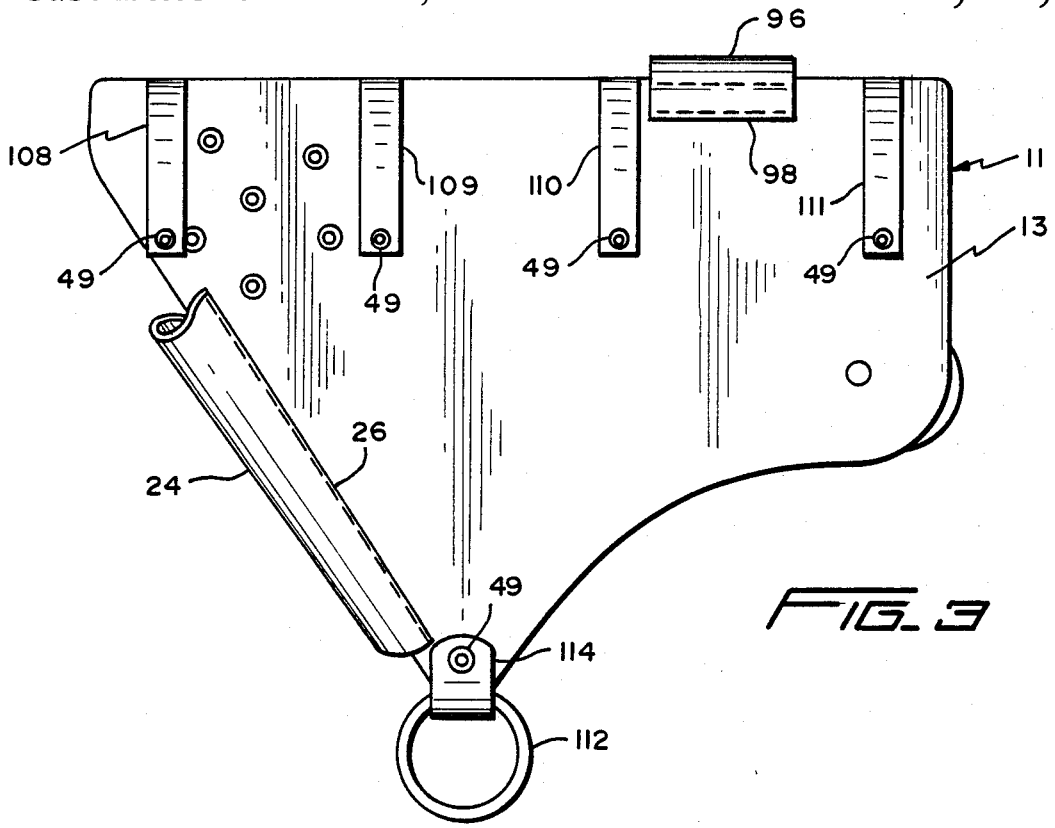
FIG. 3
FIG. 4
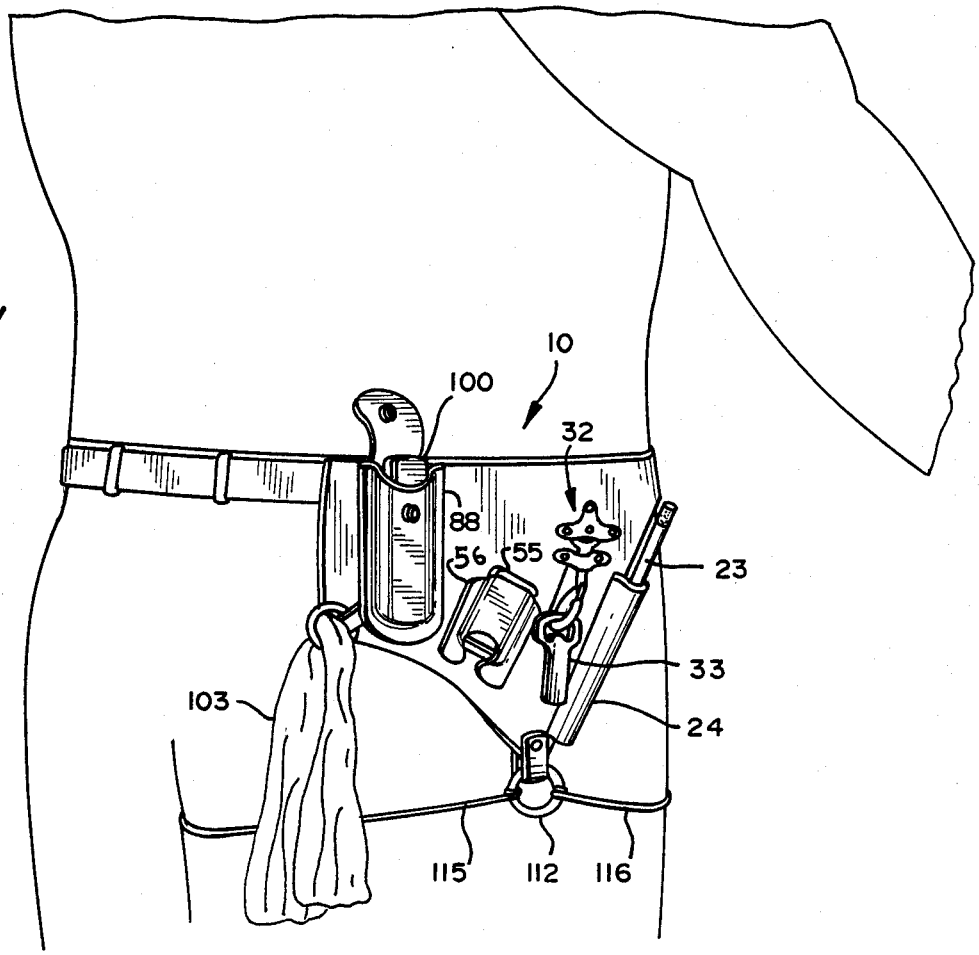

TOOL HOLDER

FIELD OF THE INVENTION

This invention relates to a tool holder and, more particularly, to a holder for bartending tools.

BACKGROUND OF THE INVENTION

A variety of tools are essential to the proper operation of a bar. Bartenders require the use of a pen, bottle opener, lighter, knife, and towel many times during the course of an average work shift. In the past, there was no single, organized storage location for these tools. As a result, these tools were often misplaced in any number of pockets, shelves, or drawers, and occasionally even the ice bin during hectic shifts. The time spent searching for misplaced tools reduced the bartender's efficiency and, consequently, the quality of service to the customer, the number of drinks prepared during a shift, and the income to both the bar's owner and the bartender.

Numerous tool holders are presently available. However, these tool holders are intended for use in other trades and are incapable of holding and efficiently organizing a bartender's pen, bottle opener, lighter, knife, and towel in a manner which will increase the bartender's efficiency.

Accordingly, a need exists for a tool holder which holds and efficiently organizes the tools of the bartender's trade.

SUMMARY OF THE INVENTION

It is an object of the present invention to efficiently organize a bartender's pen, bottle opener, lighter, knife, and towel.

It is a further object of the present invention to securely hold a pen, bottle opener, lighter, knife, and towel while permitting single-handed removal and replacement of each tool.

These and other objects and advantages of the present invention are achieved with a tool holder according to one aspect of the invention which has a pliable support, a pocket for holding a pen having a first edge attached to a first side of the support and a second edge attached to a second side of the support, a hook means attached to the first side of the support for holding a bottle opener, a second pocket attached to the first side of the support for holding a lighter, a third pocket attached to the first side of the support for holding a knife, a ring attached to the first side of the support for holding a towel, and a means for securing the support to the body of a user so that the second side of the support is adjacent a hip of the user.

In accordance with another aspect of the invention, the hook means for holding a bottle opener includes a fixed hook and a latch, the fixed hook having a base which is adjacent the first side of the support and a leg which is integral with and curves back over a lower portion of the base and the latch having a first end connected to an upper portion of the base and a second end which is normally biased into contact with the leg. A means for attaching the hook means to the first side of the support inhibits movement of the fixed hook with respect to the support.

In accordance with another aspect of the invention, the pocket for holding a lighter has a top edge, a first side edge, a second side edge, a bottom edge, a first side wall connected to the first side edge, a second side wall connected to the second side edge, a bottom wall connected to the bottom edge, an outer wall connected to the first side wall, second side wall, and bottom wall, and a cutout extending from a lower portion of the outer wall through the bottom wall and bottom edge. The first side edge, second side edge, and bottom edge are attached to the first side of the support. The first side wall, second side wall, and bottom wall extend in an outward direction from the first side of the support. A ramp is attached to the first side of the support and has first and second planar surfaces which are inclined at an angle with respect to the first side of the support and meet at a ridge spaced apart from the first side of the support. The second planar surface and ridge are located between the first side of the support and the pocket.

In accordance with another aspect of the invention, the position of the support can be adjusted to insure a comfortable fit for bartenders of different physical proportions. The invention accomplishes this with a belt which passes through first and second belt loops which are attached to an upper portion of a second side of the support and have a first vertical dimension. The belt has a width which is less than the first vertical dimension to permit adjustment of the support to a desired relative position with respect to the belt. The support is held in a desired position by a means for releasably fastening the support to the belt.

BRIEF DESCRIPTION OF THE DRAWINGS

FIG. 3 is a rear view of the tool holder of FIG. 1.

FIG. 4 shows the tool holder of FIG. 1 in use.

Figure 6:
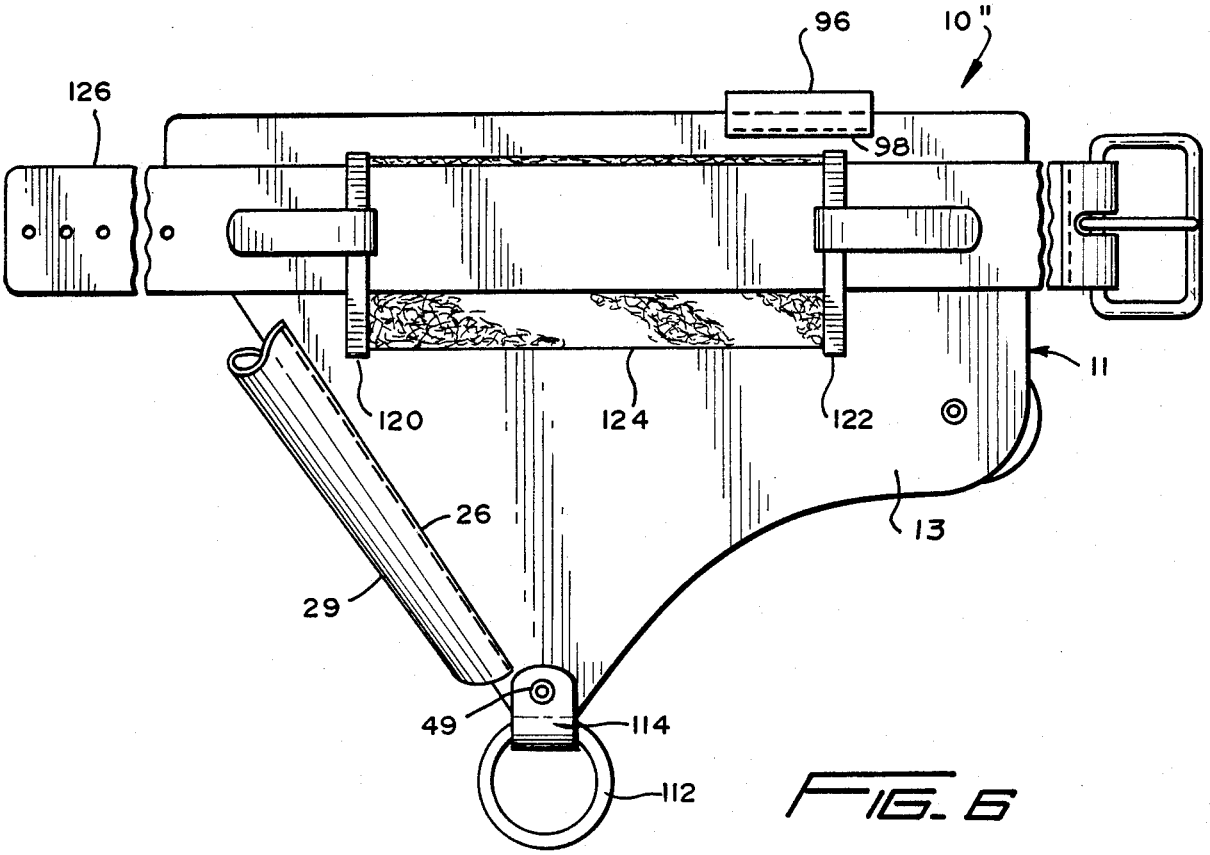
FIG. 6 is a rear view of a third embodiment of a tool holder according to the present invention.
Figure 7A:
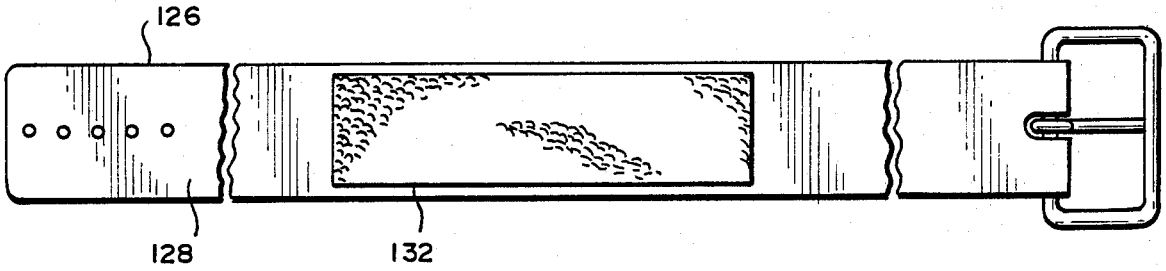
Figure 7B:
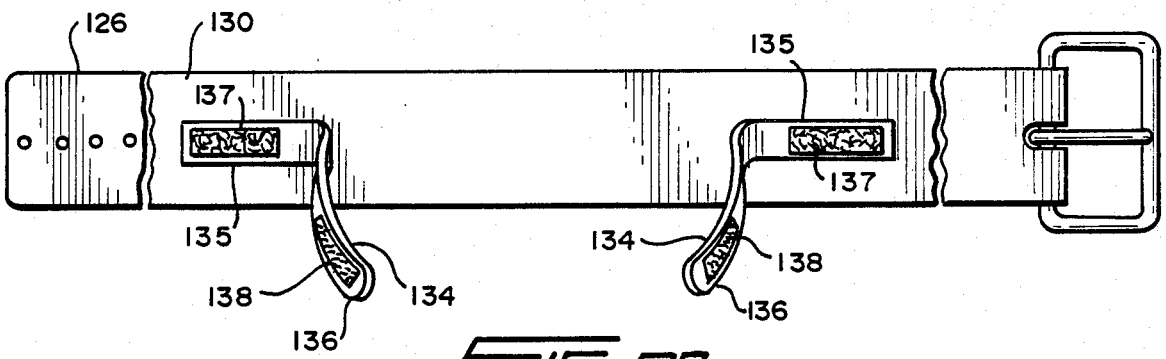

FIG. *7a* shows a first side of the belt in FIG. 6.

FIG. *7b* shows a second side of the belt in FIG. 6.

Figure 8:
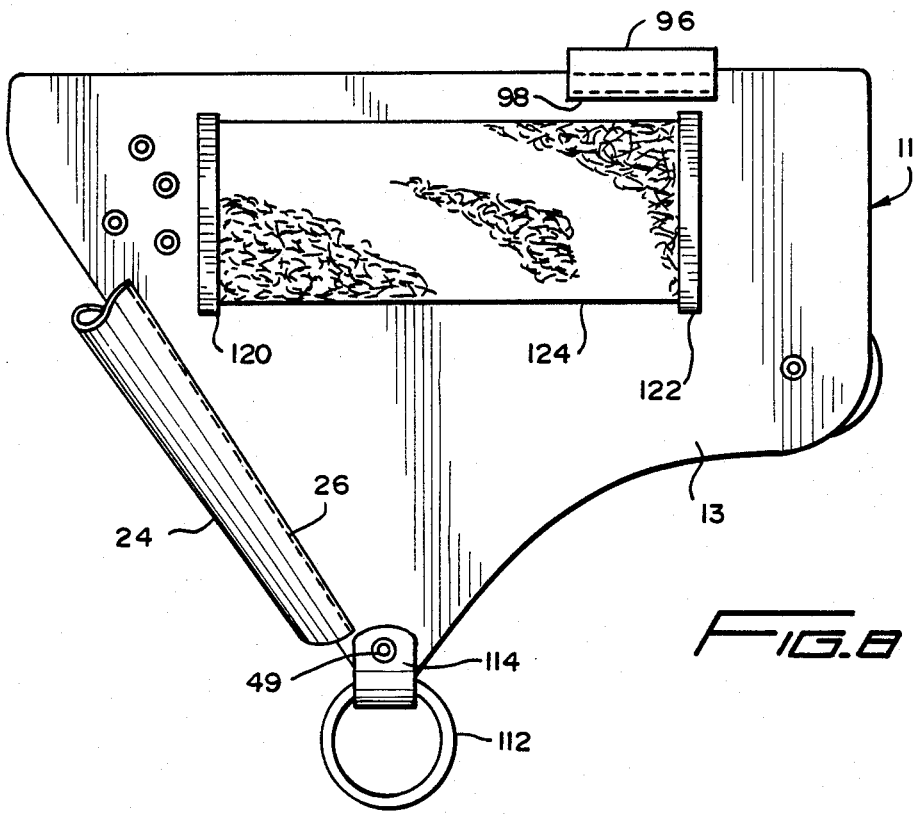

FIG. 8 shows a rear view of the support in FIG. 6.

DETAILED DESCRIPTION

FIGS. 1–4 show a tool holder 10 according to a first embodiment of the invention. Tool holder 10 is worn on a bartender's hip, secured to his waist and leg, and organizes a bartender's pen, bottle opener, lighter, knife, and towel so that they are easily accessible. Tool holder 10 includes a flat support 11 which is made from a durable, pliable material, such as leather. Other materials, including cloth, plastic, animal skins and neoprene, may also be used to make support 11. Support 11 has a front side 12 and a back side 13. In use, front side 12 is positioned away from the bartender's body and back side 13 is positioned adjacent the bartender's body. Support 11 has a generally straight top edge 14, a generally straight front edge 16 which forms an acute angle of about 55 degrees with respect to top edge 14, and rear edge 18. Rear edge 18 has a first portion 19 which is generally straight and extends in a perpendicular direction from top edge 14 and a second portion 20 which is inclined toward front edge 16.

Tool holder 10 includes a pocket 24 attached to support 11 adjacent front edge 16 for holding a pen. Pocket 24 is made from a durable, pliable material, preferably the same material from which support 11 is made.

Pocket 24 has a first side edge 25 attached to front side 12 of support 11 adjacent front edge 16 and a second side edge 26 attached to back side 13 of support 11 adjacent front edge 16. As a result, pocket 24 extends in a forward direction from front edge 16 of support 11. First side edge 25 and second side edge 26 are preferably attached to support 11 by stitching, although other attaching means such as rivets or adhesives could also be used. Second side edge 26 is longer than first side edge 25 so that portion 27 on the inside surface of pocket 24 below top edge 29 is exposed. Portion 27 extends above opening 28 and is adjacent the bartender's leg when tool holder 10 is in use. When pen 23 is to be inserted into pocket 24, the tip of the pen can contact portion 27 which will help guide pen 23 smoothly into opening 28 while protecting the bartender's clothes.

Pocket 24 is tapered with the size of opening 28 being slightly greater than the diameter of pen 23 near top edge 29 and approximately equal to the diameter of pen 23 near bottom portion 30. As a result, initial insertion of pen 23 into pocket 24 is relatively easy while pen 23 is held firmly in place when it is completely inserted with its tip adjacent bottom portion 30 of pocket 24. Bottom portion 30 of pocket 24 is closed so that when pen 23 is in pocket 24 the tip of pen 23 is not exposed. The length of pocket 24 is approximately one-half that of pen 23 so that one-half of pen 23 is exposed when the pen is completely inserted in pocket 24. This fact together with the fact that pocket 24 holds the exposed portion of pen 23 in front of support 11 so that support 11 does not interfere with the bartender's ability to grasp pen 23 permits the bartender to quickly and easily remove pen 23 from pocket 24 using the same grip that is used to hold the pen when writing. Ease of removal of pen 23 is further enhanced by the fact that pocket 24 holds pen 23 parallel to front edge 16 of support 11 to permit insertion and removal of the pen using a comfortable forward and upward arm motion.

Tool holder 10 also includes a spring hook 32 which is attached to front side 12 of support 11 for holding a bottle opener 33. Spring hook 32 includes a fixed hook 34 which has a base 36 and a leg 38 which curves back over and is integrally connected with the lower portion of base 36. Spring hook 32 also includes an eye 46 which is integrally connected with the upper portion of base 36 and a latch 40 which is rotatably connected with the upper portion of base 36 by way of a shaft (not shown). The shaft passes through a first end of latch 40 and is held by the upper portion of base 36. Hook 32 has a normally closed position in which the second end of latch 40 is biased into contact with leg 38 by a spring (not shown) which is connected to base 36 and latch 40 adjacent the shaft. Spring hook 32 can be opened by depressing latch 40 toward base 36.

Spring hook 32 is attached to support 11 above pen holder 22 with fixed hook 34 and latch 40 generally parallel with front edge 16. Spring hook 32 is attached to support 11 by straps 48 and 50 which inhibit movement of base 36 with respect to support 11 and are preferably made from the same material as support 11. Strap 48 straddles base 36 and is attached to first side 12 of support 11 at its first and second ends on either side of base 36 by rivets 49. Strap 50 is T-shaped and has a first segment 51 and a second segment 52 which is perpendicular to and integrally connected to segment 51. Segment 51 straddles eye 46 and is attached to support 11 at its first and second ends which lie outside of eye 46 and at a point between the first and second end through an opening at the center of eye 46 by rivets 49. Segment 52 is attached to support 11 at its third end which lies outside of eye 46.

The fact that straps 48 and 50 inhibit movement of base 36 with respect to support 11 permits a user to single-handedly remove bottle opener 33 from spring hook 32 with ease. This is accomplished by grasping bottle opener 33 with one hand and rotating the bottle opener so that the top portion of the bottle opener depresses latch 40 and can be removed.

Tool holder 10 also includes a pocket 56 attached to front side 12 of support 11 to the rear of spring hook 32 for holding a cigarette lighter 55. Pocket 56 is made from a durable, pliable material, preferably the same material from which support 11 is made. Pocket 56 has a top edge 59, a first side edge 60, a second side edge 64, and a bottom edge 66. First and second side edges 60 and 64 and bottom edge 66 are preferably attached to support 11 by stitching although other attaching means such as rivets or adhesives could also be used. Pocket 56 has a first side wall 68, a second side wall 70, a bottom wall 72, and an outer wall 76. First and second side walls 68 and 70 are integrally connected to first and second side edges 60 and 64, respectively, and extend outwardly from front side 12 of support 11. Bottom wall 72 is integrally connected to bottom edge 66 and extends outwardly from front side 12 of support 11. Outer wall 76 is integrally connected to first and second side walls 68 and 70 and to bottom wall 72. Cutout portion 58 extends from the lower portion of outer wall 76 through bottom wall 72 and bottom edge 66.

First and second side edges 60 and 62 are parallel and are inclined at an acute angle of about 65 degrees with respect to top edge 14 of support 11. Since side edges 60 and 62 form an acute angle with respect to top edge 14 which is greater than the angle formed by front edge 16 with respect to top edge 14, this orientation permits lighter 55 to be removed from pocket 56 using a comfortable forward and upward lifting motion without interference from spring hook 32.

Figure 1:
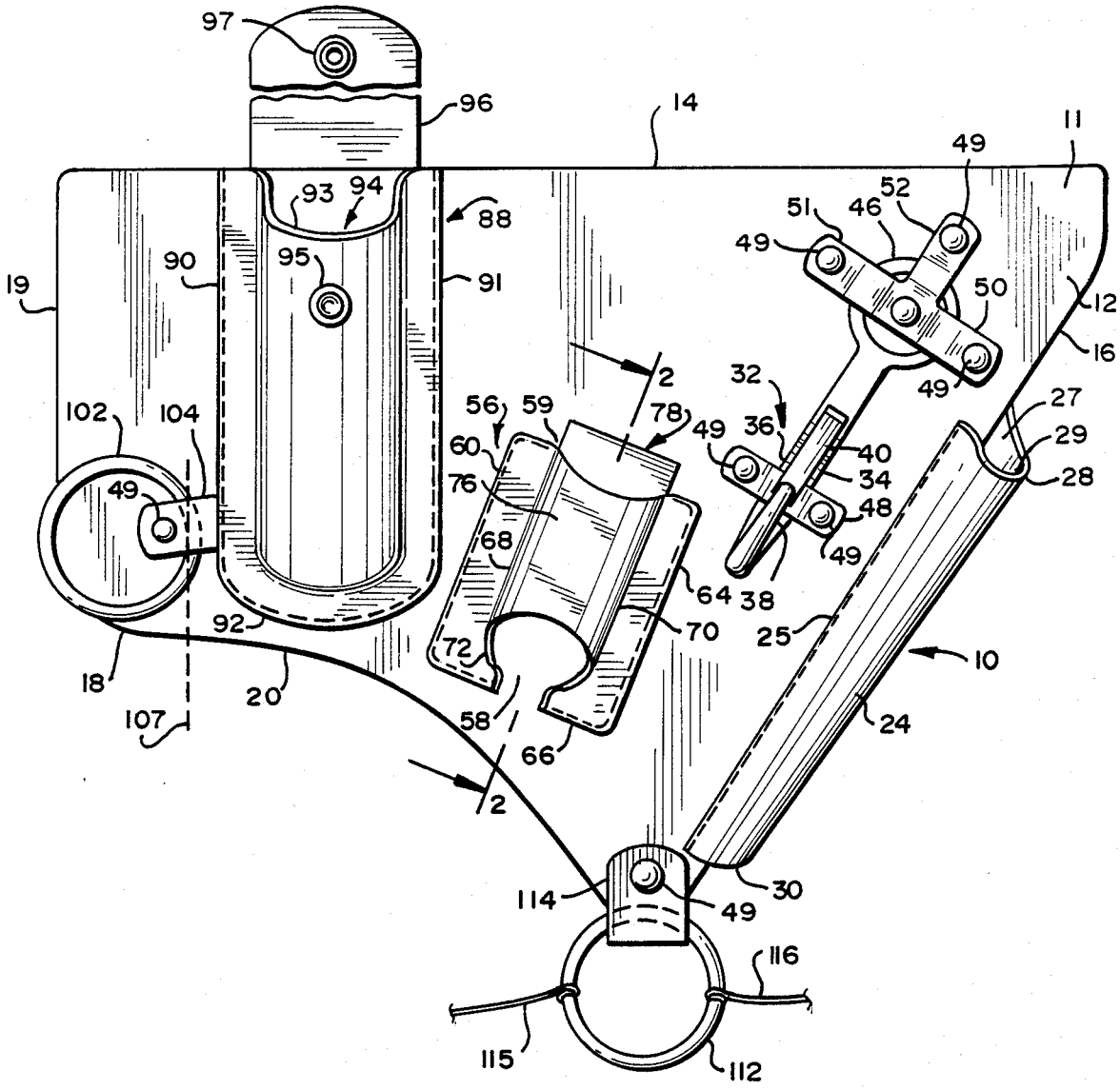
FIG. 1 is a front view of a first embodiment of a tool holder according to the present invention.
Figure 2:
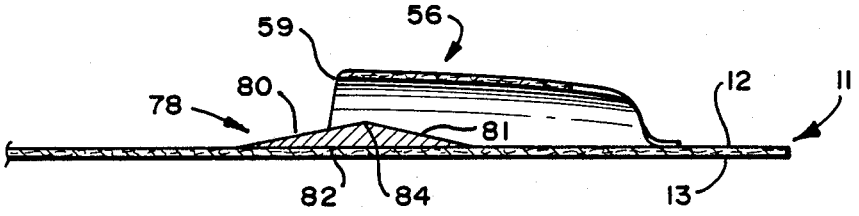
FIG. 2 is a cross-section taken along section lines 2—2 of FIG. 1.

Associated with pocket 56 is a double-sided ramp 78 which is attached to front side 12 of support 11. As seen in FIG. 2, ramp 78 has a triangular cross-section formed by first, second, and third rectangularly-shaped planar surfaces 80, 81, and 82, respectively. First and second planar surfaces 80 and 81 are inclined at acute angles with respect to front side 12 of surface 11 and meet at ridge 84. Ramp 78 is positioned so that pocket 56 covers the entire second planar surface 81 and a portion of first planar surface 80 with ridge 84 located slightly below top edge 59 of pocket 56. Ramp 78 is made from a durable, pliable material, preferably the same material from which support 11 is made. Ramp 78 is preferably attached to support 11 by stitching although other attaching means, such as rivets or adhesives could also be used.

Lighter 55 is removed from pocket 56 by placing a finger in contact with the bottom of the lighter 55 through cutout portion 58 and pushing the lighter toward top edge 59. As lighter 55 moves toward top edge 59, the top portion edge of lighter 55 contacts second planar surface 81 of ramp 78. Lighter 55 is inclined at an angle with respect to first side 12 of support 11 as the top portion of lighter 55 moves up second planar surface 81.

The top portion of lighter 55 passes over ridge 84 and eventually contacts top edge 59, which has sufficient flexibility to yield, thus permitting lighter 55 to continue moving out of pocket 56. Ridge 84 is preferably between ⅛ and ¼ of an inch above front side 12 of surface 11 so that the top portion of lighter 55, once it has cleared top edge 59, is not in contact with any portion of tool holder 10. In this position, the thumb and index finger can grasp the inside and outside top edges of lighter 55 and completely withdraw the lighter. Ridge 84 thus provides unobstructed access to lighter 55 permitting the bartender to firmly grasp the lighter during its removal. Lighter 55 is returned to pocket 56 by placing the bottom edge of lighter 55 in contact with first planar surface 80 and pushing the lighter toward the bottom wall of pocket 56. Lighter 55 contacts top edge 59 of pocket 56 which yields sufficiently to permit lighter 55 to pass over ridge 84 and completely into pocket 56. In addition to facilitating grasping of lighter 55 during removal by the bartender, ramp 78 also helps prevent lighter 55 from accidently falling out of pocket 56 when the bartender bends over, for example. This is due to the fact that top edge 59 will not yield sufficiently to gravity alone to permit lighter 55 to pass over ridge 84 of ramp 78.

Tool holder 10 also includes a pocket 88 attached to front side 12 of support 11 for holding a knife. Pocket 88 is made from a durable, pliable material, preferably the same material from which support 11 is made. Pocket 88 has a first side edge 90, a second side edge 91, a bottom edge 92, and a top edge 93. First side edge 90, second side edge 91, and bottom edge 92 are attached to support 11, preferably by stitching although other attaching means such as rivets or adhesives could also be used. Pocket 88 is positioned on support 11 to the rear of pocket 56 with top edge 93 adjacent top edge 14, to define an opening 94.

A flap 96 is associated with pocket 88. Flap 96 is made from a durable, pliable material preferably the same material from which support 11 is made. Flap 96 has an edge 98 which is attached to back side 13 of support 11 adjacent top edge 14. In its closed position, flap 96 covers opening 94. A male snap fastener 95 on pocket 88 mates with female snap fastener 97 to secure flap 96 in its closed position. In its open position, flap 96 extends in an upward direction from support 11 permitting knife 100 to be removed from or inserted into pocket 88.

Tool holder 10 also includes a ring 102 attached to front side 12 of support 11 to the rear of knife sheath 86 for holding a towel 103. Ring 102 is made from a strong material, such as brass, which is capable of withstanding exposure to alcohol and water. Ring 102 is attached to support 11 by a strap 104. Strap 104 straddles a portion of ring 102 and has a first end attached to support 11 by a rivet 49. Strap 104 has a second end which lies under a lower portion of first side edge 90 of knife sheath and is attached to support 11 by the same stitching which attaches that portion of first side edge 90 to support 11. Strap 104 is oriented so that it is parallel to top edge 14 of support 11. This orientation permits ring 102 to rotate about an axis 107 which is perpendicular to top edge 14 of support 11. Since a bartender works on his feet, strap 104 is generally horizontal and axis 107 is generally vertical. This permits the bartender to insert and remove towel 103 from ring 102 using a natural horizontal pulling motion. Towel 103 is inserted into ring 102 by placing an end of the towel through ring 102 and pulling approximately one-quarter to one-third of the towel through ring 102 in a forward direction. Towel 12 is removed from ring 102 by pulling the rear end of the towel in a backward direction until the other end passes through and the towel is free from ring 102. The rear portion of support 11 extends below ring 102 in order to protect the bartender's clothes from moisture which may be wrung from towel 103 as is passes through ring 102.

Tool holder 10 includes belt loops 108, 109, 110, and 111 which are attached to the upper portion of back side 13 of support 11. Belt loops 108, 109, 110, and 111 are made from a durable, pliable material, preferably the same material from which support 11 is made. The upper end of each of belt loops 108, 109, 110, and 111 is preferably integral with and extends from top edge 14 of support 11. The lower end of each of the belt loops is preferably attached to support 11 by a rivet 49, although other attaching means such as stitching or adhesives could also be used. Tool holder 10 is secured to the bartender's waist by passing a waist belt through loops 108, 109, 110, and 111 and then fastening the waist belt around the bartender's waist. Tool holder 10 includes a ring 112 attached to the lower portion of front side 12 of support 11. Ring 112, which like ring 102 may be made of brass, is attached to support 11 by a strap 114 which straddles a portion of ring 112. Strap 114 has a first end attached to front side 12 of support 11 by a rivet 49 and a second end attached to front side 12 of support 11 by a rivet 49. A first strap 115 and a second strap 116 are attached to ring 112 at their first ends. The second ends of straps 115 and 116 can be tied together around the bartender's leg to secure the lower portion of support 11 to the bartender's leg. Straps which buckle together could be used in place of tie straps 115 and 116.

As shown in FIG. 4, tool holder 10 efficiently organizes a bartender's tools by providing a separate location for each tool and by placing them at his fingertips for easy, single-handed removal. The ability to remove tools with a single hand is especially beneficial to handicapped bartenders having the use of only one hand. In addition, tool holder 10 is small enough to fit comfortably over the bartender's hip and not interfere with the bartender's movement.

Figure 5:
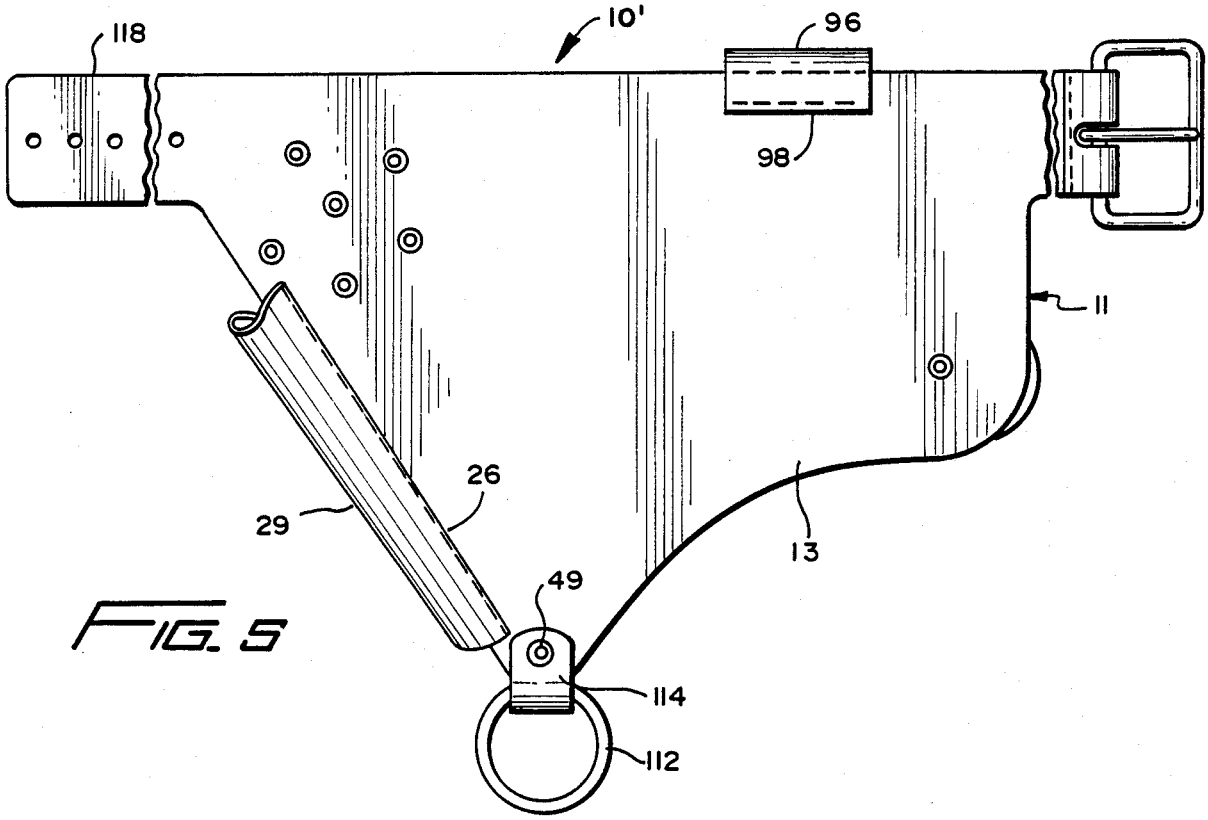
FIG. 5 is a rear view of a second embodiment of a tool holder according to the present invention.

FIG. 5 is a rear view of a tool holder 10' according to a second embodiment of the invention. Tool holder 10' of FIG. 5 is identical to tool holder 10 of FIGS. 1–4 with the exception that in place of belt loops 108, 109, 110, and 111, a belt 118 is integrally connected formed with the top portion of support 11 to secure tool holder 10' to the bartender's waist.

FIG. 6 is a rear view of a tool holder 10" according to a third embodiment of the invention in which support 11 can be adjusted in horizontal and vertical directions to insure a comfortable fit for bartenders of different physical proportions. Tool holder 10" of FIG. 6 is identical to tool holder 10 of FIGS. 1–4 with the exception of the means for securing the tool holder to the bartender's waist. In place of belt loops 108, 109, 110, and 111, tool holder 10" has belt loops 120 and 122, fastener panel 124, and a belt 126 to secure the tool holder to the bartender's waist. Belt loops 120 and 122 are attached to opposite ends of the upper portion of back side 13 of support 11. Belt loops 120 and 122 are made from a rigid material, such as metal. Fastener panel 124 is attached to the upper portion of back side 13 of support 11 between belt loops 120 and 122 preferably by stitching, although other attaching means such as rivets or adhesives could also be used. As seen in FIG. 8, fastener panel 124 has a width which is equal to the vertical dimension of belt loops 120 and 122. Belt 126 has a width which is less than the vertical dimension of belt loops 120 and 122 to permit vertical adjustment of support 11. Belt 126 has a first side 128, as seen in FIG. *7a*, which faces away from the bartender's body when tool holder 10'' is secured to the bartender's waist. Belt 126 has a second side 130, as seen in FIG. *7b*, which faces toward the bartender's body when tool holder 10'' is secured to the bartender's waist.

A fastener panel 132 is attached to first side 128 of belt 126. Fastener panels 124 and 132 are complimentary hook-and-pile fasteners, such as those commonly sold under the trademark VELCRO, which adhere to one another when placed in contact.

A pair of straps 134 is attached to second side 130 of belt 123 adjacent each end of fastener panel 132. Each strap 134 has a first portion 135 which is attached to side 130 of belt 123 and a second portion 136 which is free to extend in an outward direction from belt 123. Complimentary hook-and-pile fastener panels 137 and 138 are attached to first portion 135 and second portion 136, respectively, of straps 134. In use, belt 126 is threaded through belt loops 120 and 122 until fastener panels 124 and 132 overlap and straps 134 extend through belt loops 120 and 122. Support 11 is then moved along the length of belt 126 until the desired horizontal position of support 11 with respect to the bartender's waist is reached.

After the desired horizontal position is reached, support 11 is moved in a direction perpendicular to the length of belt 126 until the desired vertical position of support 11 with respect to the bartender's waist is achieved. Fastener panels 124 and 132 are then pressed together causing them to adhere to one another and securing support 11 in the desired position with respect to belt 126. Second portion 136 of each of straps 134 is then folded over first portion 135 until straps 134 pull firmly on and securely hold belt loops 120 and 122. Fastener panels 137 and 138 are then pressed together causing them to adhere to one another.

I claim:

1. A tool holder, comprising:

a pliable support having a first side, a second side, a top edge, a front edge inclined at a first acute angle with respect to the top edge, and a rear edge;

a first pocket for holding a pen, the first pocket having a top edge, a first side edge attached to the first side of the support adjacent the front edge of the support, and a second side edge attached to the second side of the support adjacent the front edge of the support;

a hook means attached to the first side of the support for holding a bottle opener;

a second pocket attached to the first side of the support for holding a lighter;

a third pocket attached to the first side of the support for holding a knife;

a ring attached to the first side of the support for holding a towel; and a means for securing the support to the body of a user so that the second side of the support is adjacent a hip of the user.

2. A tool holder, as in claim 1, in which the hook means is attached to the first side of the support adjacent the first pocket and is generally parallel to the front edge, the second pocket is attached to the first side of the support and lies between the rear edge and the hook means and has first and second side edges which are oriented at a second acute angle with respect to the top edge of the support which is greater than the first acute angle, the third pocket is attached to the first side of the support and lies between the rear edge and the second pocket and has first and second side edges which are generally perpendicular to the top edge of the support, and the ring is attached to the first side of the support and lies between the rear edge and the third pocket.

3. A tool holder as in claim 1, in which the second side edge of the first pocket is longer than the first side edge so that an inner surface of the first pocket adjacent the second side edge extends above an opening in the first pocket.

4. A tool holder, as in claim 3, in which the first pocket is tapered and has a closed bottom portion.

5. A tool holder as in claim 1, in which the hook means comprises:

a fixed hook having a with two sides which is adjacent the first side of the support and a leg which is integral with and curves back over a lower portion of the base;

a latch having a first end connected to an upper portion of the base and a second end which is normally biased into contact with the leg; and an eye connected to the upper portion of the base.

6. A tool holder, as in claim 5, in which the hook means is attached to the first side of the support by a first strap and a second strap, the first strap having a first end and a second end and being attached to the first side of the support at the first end and the second end on either side of the base; the second strap having a first segment and a second segment which is perpendicular to the first segment, the first segment having a first end and a second end and being attached to the first side of the support at the first end and the second end outside of the eye and at a point between the first end and the second end through an opening in the eye, the second segment having a third end and being attached to the first side of the support at the third end outside of the eye.

7. A tool holder, as in claim 1, in which the second pocket has a top edge, a first side edge, a second side edge, a bottom edge, a first side wall connected to the first side edge, a second side wall connected to the second side edge, a bottom wall connected to the bottom edge, an outer wall connected to the first side wall, second side wall, and bottom wall, and a cutout extending from a lower portion of the outer wall through the bottom wall and bottom edge, the first side edge, second side edge, and bottom edge being attached to the first side of the support, the first side wall, second side wall, and bottom wall extending in an outward direction from the first side of the support.

8. A tool holder, as in claim 7, further comprising a ramp attached to the first side of the support, the ramp having first and second planar surfaces which are inclined at an angle with respect to the first side of the support and meet at a ridge spaced apart from the first side of the support, the second planar surface and ridge being located between the first side of the support and the second pocket.

9. A tool holder, as in claim 1, in which the third pocket has a top edge, a first side edge, a second side edge, and a bottom edge, the first side edge, second side edge, and bottom edge being attached to the first side of the support, the top edge of the third pocket being located adjacent the top edge of the support and defining an opening in the third pocket.

10. A tool holder, as in claim 9, further comprising:

a flap attached to the second side of the support adjacent the top edge of the support; and a means for releasably connecting the flap to the third pocket so as to cover the opening in the third pocket.

11. A tool holder, as in claim 10, in which the means for releasably connecting the flap to the third pocket comprises a first snap fastener attached to the flap and a complementary second snap fastener attached to the third pocket.

12. A tool holder, as in claim 1, in which the ring has an opening and is attached to the first side of the support by a strap which passes through the opening in the ring and straddles a portion of the ring, the strap being oriented so that it is parallel with the top edge of the support and having first and second ends which are attached to the first side of the support.

13. A tool holder, as in claim 12, in which a portion of the support extends below the ring to protect the body of the user from moisture in the towel.

14. A tool holder, as in claim 1, in which the means for securing comprises:

a first means for securing an upper portion of the support to the waist of a user.

15. A tool holder, as in claim 14, in which the means for securing further comprises:

a second means for securing a lower portion of the support to the leg of a user.

16. A tool holder, as in claim 15, in which the second means for securing comprises:

a ring attached to the lower portion of the support; and a pair of straps, each strap having a first end connected to the ring and a free second end, the straps encircling the leg of a user and being tied together at their second ends to secure the lower portion of the support to the leg of a user.

17. A tool holder, as in claim 14, in which the first means for securing comprises a plurality of belt loops attached to an upper portion of the second side of the support.

18. A tool holder, as in claim 14, in which the first means for securing comprises a belt integrally connected to the support.

19. A tool holder, as in claim 14, in which the first means for securing comprises:

first and second belt loops attached to an upper portion of the second side of the support and having a first vertical dimension;

a belt, having a first side and a second side, which passes through the first and second belt loops and has a width which is less than the first vertical dimension to permit adjustment of the support with respect to the belt to a desired relative position; and a means for releasably fastening the support to the belt at the desired relative position.

20. A tool holder, as in claim 19, in which the means for releasably fastening, comprises:

first and second complementary hook-and-pile fasteners, the first fastener being attached to the upper portion of the second side of the support between the first and second belt loops and the second fastener being attached to the second side of the belt.

21. A tool holder, as in claim 20, in which the means for releasably fastening further comprises:

a first strap having a first portion which is attached to the first side of the belt and passes through the first belt loop and a movable second portion which passes over and encircles the first belt loop;

a first means for releasably fastening the second portion of the first strap to the first portion of the first strap to securely hold the first belt loop;

a second strap having a first portion which is attached to the first side of the belt and passes through the second belt loop and a movable second portion which passes over and encircles the second belt loop;

a second means for releasably fastening the second portion of the second strap to the first portion of the second strap to securely hold the second belt loop.

22. A tool holder, as in claim 21, in which the first means for releasably fastening comprises third and fourth complimentary hook-and-pile fasteners, the third fastener being attached to the first portion of the first strap, the fourth fastener being attached to the second portion of the first strap and the second means for releasably fastening comprises fifth and sixth complimentary hook-and-pile fasteners, the fifth fastener being attached to the first portion of the second strap and the sixth fastener being attached to the second portion of the second strap.

* * * * *